US010809752B2

(12) United States Patent
Hurwitz et al.

(10) Patent No.: US 10,809,752 B2
(45) Date of Patent: Oct. 20, 2020

(54) BANDGAP VOLTAGE REFERENCE, AND A PRECISION VOLTAGE SOURCE INCLUDING SUCH A BANDGAP VOLTAGE REFERENCE

(71) Applicant: Analog Devices International Unlimited Company, Limerick (IE)

(72) Inventors: Jonathan Ephraim David Hurwitz, Edinburgh (GB); Gergely Toldi, Dunakeszi (HU)

(73) Assignee: Analog Devices International Unlimited Company, Limerick (IE)

( * ) Notice: Subject to any disclaimer, the term of this patent is extended or adjusted under 35 U.S.C. 154(b) by 0 days.

(21) Appl. No.: 16/214,275

(22) Filed: Dec. 10, 2018

(65) Prior Publication Data

US 2020/0183434 A1 Jun. 11, 2020

(51) Int. Cl.
*G05F 1/567* (2006.01)
*G05F 1/575* (2006.01)
*G05F 1/577* (2006.01)

(52) U.S. Cl.
CPC ..... *G05F 1/575* (2013.01)

(58) Field of Classification Search
CPC ..... G05F 1/567; G05F 1/575; G05F 1/577; G05F 3/22–225
See application file for complete search history.

(56) References Cited

U.S. PATENT DOCUMENTS 4,447,784 A * 5/1984 Dobkin ..... G05F 3/265 323/226
5,325,045 A * 6/1994 Sundby ..... G05F 3/30 323/313
5,686,821 A * 11/1997 Brokaw ..... G05F 1/575 323/273
6,060,874 A * 5/2000 Doorenbos ..... G05F 3/30 323/316
6,288,525 B1 * 9/2001 Fischer ..... G05F 3/30 323/313
8,508,211 B1 * 8/2013 Anderson ..... G05F 3/30 323/313
9,285,820 B2 * 3/2016 Kalb ..... G05F 3/20
9,684,325 B1 * 6/2017 Rasmus ..... G05F 1/575
2014/0084989 A1 * 3/2014 Fujime ..... G05F 1/625 327/513
2017/0227975 A1 * 8/2017 Chu ..... G05F 3/30

OTHER PUBLICATIONS

Williams, C. Lea, "Optimization and Tempature Dependence of Current Gain in Polysilicon-Emitter-Contracted Bipolar Transistors", PhD Thesis "Optimization and temperature dependence of current gain in Polysilicon-Emitter contacted transistors", Williams, C.Lea, Oregon Graduate Center 1988, available at: https://digitalcommons.ohsu.edu/cgi/viewcontent.cgi?article=1265&context=etd, (May 1, 1988), 52 Pgs.

* cited by examiner

*Primary Examiner* — Thienvu V Tran
*Assistant Examiner* — Sisay G Tiku
(74) *Attorney, Agent, or Firm* — Schwegman Lundberg & Woessner, P.A.

(57) ABSTRACT

A technique for improving the stability of a voltage reference is provided. The implementation of technique is simple and elegant and does not involve a noise penalty. A compensation resistor is provided on one end of a string of resistors used to set a $\Delta V_{BE}$ in a PTAT cell and to set a gain applied to the PTAT cell voltage.

20 Claims, 11 Drawing Sheets

BANDGAP VOLTAGE REFERENCE, AND A PRECISION VOLTAGE SOURCE INCLUDING SUCH A BANDGAP VOLTAGE REFERENCE

FIELD

The present disclosure relates to the provision of a precision voltage reference.

BACKGROUND

Many circuits require a known and stable reference voltage to provide the levels of accuracy required in high precision electronic systems. Bandgap voltage references have become prevalent in filling this role.

SUMMARY

As device performance, such as the resolution of analog to digital converters increases, further performance increases in the operation of voltage references are required. Furthermore the continuing march of battery powered devices offering greater functionality generally means that circuit designers are under pressure to reduce the power consumed by voltage reference circuits without compromising their voltage stability or noise performance.

A difference in base-emitter voltages between a pair of transistors can be used to form a voltage difference which is proportional to absolute temperature, PTAT. The base-emitter voltage of a single transistor decreases with increasing temperature, hence it is complementary to absolute temperature, CTAT.

The present disclosure relates to the provision of a precision voltage reference having good temperature stability and insensitivity to manufacturing process variations. It also discloses an arrangement that reduces noise in the voltage reference circuit.

Disclosed herein, amongst other things, is a technique that reduces, and indeed can inhibit, variation in PTAT output voltage resulting from base current flow in the transistors forming a PTAT voltage reference.

According to a first aspect of this disclosure there is provided a voltage reference circuit comprising a first PTAT cell, the first PTAT cell comprising first and second transistors operating at first and second current densities, respectively, such that the transistors have first and second base-emitter voltages that differ from each other. The voltage reference circuit further comprises a control circuit for controlling the base voltage difference between the first and second transistors of the first PTAT cell so as to set collector currents flowing the first and second transistors to a desired ratio. The voltage reference circuit further comprises correction circuitry or other correction means for compensating an output voltage of the voltage reference circuit against changes in output voltage due to current flow into the base of the first and second transistors.

In an embodiment the correction means is a resistor positioned between an output voltage node and a potential divider that acts to set the difference between the base voltages of the first and second transistors to a value which causes the first and second transistors to have the desired collector current ratio.

According to a second aspect of this disclosure there is provided a method of reducing the temperature coefficient of a PTAT voltage reference, the PTAT voltage reference comprising first and second bipolar transistors having their emitters at a common voltage, and wherein the base of the first transistor is connected to a first node of a first resistor and the base of the second transistor is connected to the second node of the first resistor such that current flow in the first resistor causes a voltage difference to be applied to the base of the first transistor compared to the voltage of the base of the second transistor, and where the first resistor is interposed between a first gain setting resistor and a compensation resistor.

According to a further aspect of this disclosure there is provided a voltage reference circuit comprising a first PTAT cell and a second PTAT cell. The first PTAT cell comprises first and second bipolar transistors having their emitters connected to a first shared node and arranged to operate at first and second current densities, respectively. The second PTAT cell comprises third and fourth bipolar transistors having their emitters connected to a second shared node and arranged to operate at third and fourth current densities, respectively. The first and second transistors are NPN transistors, and the third and fourth transistors are PNP transistors. A collector of the first transistor is connected to a collector of the third transistor. A collector of the second transistor is connected to a collector of the fourth transistor. Bases of the first and second transistor are connected by a first control voltage generator and bases of the third and fourth transistors are connected by a second control voltage generator.

Advantageously the first and second shared nodes are connected to first and second tail current generators, respectively. Advantageously the first, second, third and fourth transistors are controlled by a control loop such that they each pass the same current. In such an arrangement the current densities are made different by making transistors of different sizes.

Additional pairs of cells can be added. Thus a third cell and be added in conjunction with a fourth cell. The third cell contains fifth and sixth transistors, whereas the fourth cell contains seventh and eighth transistors. The fifth and sixth transistors are NPN transistors operating at different current densities to each other. The seventh and eighth transistors are PNP transistors operating at different current densities to each other. Further pairs of cells may be added.

BRIEF DESCRIPTION OF THE DRAWINGS

Some embodiments of the present disclosure will now be described, by way of non-limiting example only, with reference to the accompanying Figures, in which.

DESCRIPTION OF SOME EMBODIMENTS OF THIS DISCLOSURE

Figure 1:
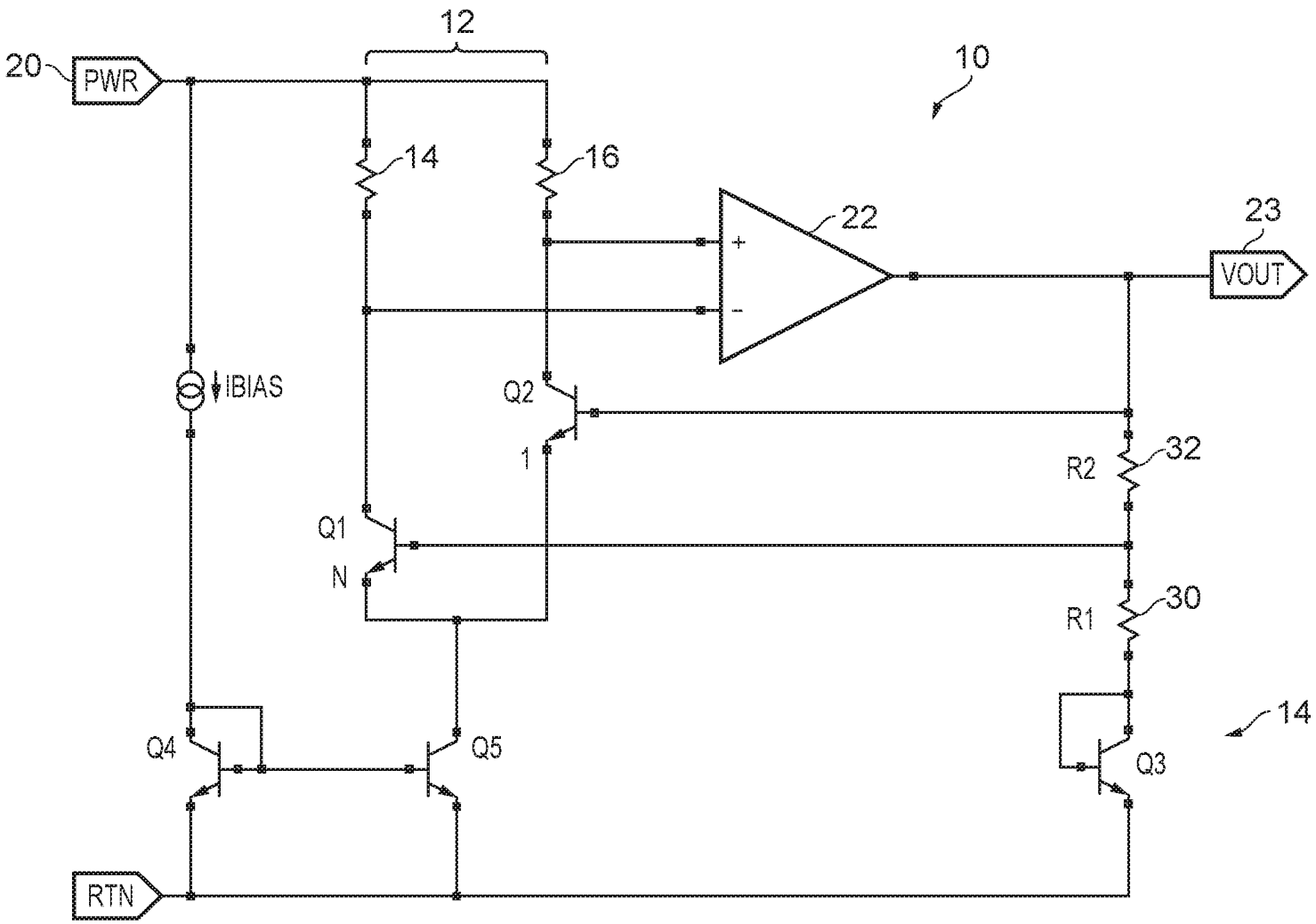
FIG. 1 is a circuit diagram of a single PTAT cell band gap voltage reference.

FIG. 1 shows a bandgap voltage reference 10 (see also, e.g., U.S. Pat. No. 8,508,211, which is incorporated herein by reference) and comprising:

1) a PTAT 12 cell formed around transistors Q1 and Q2, and 2) a CTAT cell 14 formed around transistor Q3.

The PTAT cell 12 comprises first and second transistors Q1 and Q2 in a differential pair configuration and having their emitters connected together and to a current sink (also known as a tail current generator) formed by Q5 acting as a slave transistor of a current mirror formed by transistors Q4 and Q5. The transistors Q1 and Q2 have different sized emitters with, in this example, Q1 being N times the size of Q2 (or formed by N Q2 sized transistors in parallel) such that the transistors Q1 and Q2 operate at different current densities even if they are passing identical collector currents. Each of the transistors Q1 and Q2 has a respective load resistor 14 and 16 acting to convert the current flowing through Q1 and Q2 to respective voltage differences measured with respect to the positive voltage rail 20. The voltages at the collectors of Q1 and Q2 are compared by an operational amplifier 22. An output node 23 of the operational amplifier 22 forms an output of the circuit, and is also connected to the base of Q2 and to a resistor string formed by resistors 30 and 32 having resistances R1 and R2, respectively. A first (bottom most as drawn) node of the first resistor 30 is connected to an output node of the CTAT cell 14. A second node of the first resistor 30 is connected to the base of the transistor Q1 and to a first node of the second resistor 32. A second node of the second resistor 32 is connected to the output 23 of the operational amplifier 22.

In order to see how the voltage generator works, it is advantageous to recap the operation of bipolar junction transistors.

For such a transistor, the collector current can be expressed as $$Ic = Is\ \exp\left(V_{BE} \cdot \frac{q}{kT}\right) \qquad \text{Eq. 1}$$

Whereas $I_c$=collector current $I_s$=reverse saturation current $V_{BE}$=base-emitter voltage q=charge of an electron k=Boltzmann's constant T=Temperature in Kelvin $I_s$ is proportional to device area. If we assume that transistors are identical except for having different areas, then $I_s$ can also be referred to as a current scale factor.

Equation 1 when evaluated for a range of $V_{BE}$ confirms that current conduction remains negligible until a forward voltage of around 0.6V is reached and then rises rapidly.

Equation 1 can be rewritten in terms of $V_{BE}$ $$V_{BE} = \frac{kT}{q}\ln\left(\frac{Ic}{Is}\right) \qquad \text{Eq. 2}$$

This shows that at any given temperature the base-emitter voltage is a function of T and also the current density in the device $$\frac{Ic}{Is}.$$

The term Is, the reverse saturation current, is caused by the thermal generation of electron-hole pairs within the depletion region of the base-emitter junction and the effect of diffusion currents across the depletion region of the base-emitter junction. The current, Igen, due to thermal generation of electron-hole pairs can be expressed as:

$$Igen = A\ \exp\left(\frac{-Eg}{2kT}\right) \qquad \text{Eq. 3}$$

Where Eg is the energy gap between the valence and conduction band, k is Boltzmann's constant and T is temperature in Kelvin.

Similarly the current due to diffusion, Idif, can be expressed as $$Idif = B\ \exp\left(-\frac{Eg}{kT}\right) \qquad \text{Eq. 4}$$

As a result $$Is \propto \exp\left(-\frac{Eg}{xkT}\right) \qquad \text{Eq. 5}$$

where x is between 1 and 2 depending on relative dominance of the generation and diffusion currents.

It is this temperature dependence of Is that is the driving force behind the observation that $V_{BE}$ is CTAT for a transistor, with the $V_{BE}$ decreasing at around 2 mV per degree centigrade.

As noted earlier, in FIG. 1, Q3 acts as a CTAT voltage generator.

Whilst $V_{BE}$ is a function of Is we can arrange circuits such that the changes in $V_{BE}$ due to changes in Is cancel such that the voltage difference between two matched transistors can become a function of their respective current density.

Assume the transistors Q1 and Q2 are identical save for the fact that Q1 is N times bigger that Q2. If we look at Q1 and Q2 that form the PTAT cell 12, we can see that the emitter voltages of these transistors must be identical as they are connected together.

If we know the ratio of the collector currents then we have the opportunity to equate the base voltage of Q1 and Q2

$$V_{BE}(Q1) = \frac{kT}{q}\ln\left(\frac{Ic1}{Is.N}\right) \qquad \text{Equation 6}$$

$$V_{BE}(Q2) = \frac{kT}{q}\ln\left(\frac{Ic2}{Is}\right)$$

where

Ic1=collector current of Q1

Jc2=collector current of Q2

N=scale factor between Q2 and Q1

$V_{BE}$(Q1)=base emitter voltage of Q1

$V_{BE}$(Q2)=base emitter voltage of Q2

So, as Is is common to both transistors (and they are matched by the fabrication process) we can write:

$$V_{BE}(Q2) - V_{BE}(Q1) = \Delta V_{BE} = \frac{kT}{q}\ln(I_{c2}) - \frac{kT}{q}\ln\left(\frac{I_{C1}}{N}\right) \qquad \text{Eq. 7}$$

Therefore we have a difference in base voltage between that of Q2 and Q1 which is a function of the respective collector currents and the scale factor between the transistors or more simply, the current densities in the devices.

We can provide circuits to control the collector currents to desired values. In FIG. 1 this is done by the differential amplifier 22 being in a feedback loop such that it seeks to force the voltages as it's inverting and non-inverting inputs to be the same.

The currents in Q1 and Q2 are converted to voltages by resistors 14 and 16. Consequently the ratios of the collector currents can be set by the ratios of the resistors. Thus if we wanted the collector current of Q2 to be M times the collector current of Q1, then the first resistor 14 would be M times smaller than the second resistor 16.

If for simplicity we chose to set the collector currents of Q1 and Q2 to be equal by setting the resistors 14 and 16 have equal value. We can write the current as $I_{C1}=I_{C2}=I$.

$$\therefore \Delta V_{BE} = \frac{kT}{q}\ln(I) - \frac{kT}{q}\ln\left(\frac{I}{N}\right) = \frac{kT}{q}\ln(N) \qquad \text{Eq. 8}$$

In FIG. 1, the amplifier 22 seeks to set the output voltage such that the current flowing in R2 causes $\Delta V_{BE}$ to be developed across R2.

If we evaluate $\Delta V_{BE}$ for an assumed temperature of 300 K and various scaling ratios N we see

| scaling ratio | Δ Vbe at 300 K | Δ Vbe at 301 K | change per Kelvin |
|---|---|---|---|
| 1 | 0 | 0 | 0 |
| 2 | 0.017919235 | 0.017978965 | 5.9731E−05 |
| 4 | 0.035838469 | 0.035957931 | 0.00011946 |
| 8 | 0.053757704 | 0.053936896 | 0.00017919 |
| 16 | 0.071676939 | 0.071915862 | 0.00023892 |
| 32 | 0.089596173 | 0.089894827 | 0.00029865 |
| 64 | 0.107515408 | 0.107873793 | 0.00035838 |
| 128 | 0.125434643 | 0.125852758 | 0.00041812 |
| 256 | 0.143353878 | 0.143831724 | 0.00047785 |
| 512 | 0.161273112 | 0.161810689 | 0.00053758 |
| 1024 | 0.179192347 | 0.179789655 | 0.00059731 |
| 2048 | 0.197111582 | 0.19776862 | 0.00065704 |
| 4096 | 0.215030816 | 0.215747586 | 0.00071677 |

-continued

| scaling ratio | Δ Vbe at 300 K | Δ Vbe at 301 K | change per Kelvin |
|---|---|---|---|
| 8192 | 0.232950051 | 0.233726551 | 0.0007765 |
| 16384 | 0.250869286 | 0.251705517 | 0.00083623 |

Using k = $1.38064852 \times 10^{-23}$ $m^2$ $kgs^{-2}$ $K^{-1}$
Q = $1.60217662 \times 10^{-19}$ coulombs We see that the change in $V_{BE}$ per kelvin is modest, and only 0.238 mV per degree Kelvin with a current scaling ratio of 16:1.

Subject to the fact that the current conduction in Q3 needs a $V_{BE}$ of around 0.6V then transistor Q3 forming the CTAT cell has a base-emitter voltage that drops by around 2 mV per kelvin.

Briefly, bandgap based precision voltage references work by taking the approximate −2 mV per kelvin CTAT voltage drop and cancelling that by summing this with an amplified version of the PTAT voltage, which for a scale factor N of 8 exhibits a change of around 0.179 mV per degree kelvin, which means a gain of around 11 is required to match these opposing temperature effects. In fact it can also be shown that the gain is equal to the ratio of the CTAT voltage to $\Delta V_{BE}$.

In practice the gain needed may need to be trimmed from batch to batch to achieve an improved or optimum temperature coefficient to compensate for errors in the nominal $V_{BE}$ from variations in Q3 and for other errors in the system from the other components. This trimming is often done by trimming the relative value of R1 vs R2. This can be done, for example, by providing R1 and R2 as oversized components with short-able subsections therein such that they can be electronically trimmed.

The gain required by the amplifier 22 reduces with an increased $\Delta V_{BE}$. We know that $\Delta V_{BE}$ occurs across resistor R2 by virtue of the current I flowing in R2.

so $\Delta V_{BE}$=I.R2

Resistor 32 of value R2 acts as a current to control voltage converter for controlling the relative voltages of the bases of Q1 and Q2 to be proportional to the current flowing in the resistor 32.

Ignoring base currents, the same current I also flows in R1. Consequently $$\text{Vout}=\text{IR1}+\text{IR2}+V_{BE}(\text{Q3, I}) \qquad \text{Eq. 9}$$

where $V_{BE}$ (Q3,I) represents the base-emitter voltage in Q3 for current I.

If a small change change $d\Delta V_{BE}$ occurs, then we get a change in $V_{out}$ $$\Delta V_{out}=(I_1-I)R1+(I_1-I)R2+(V_{BE}(Q3, I_1)-V_{BE}(Q3,I)) \qquad \text{Eq. 10}$$

Where $I_1$ represents the new current in R2 as a result of the change $\Delta V_{BE}$.

We can rewrite the final term using expressions like those used in Equations 7 and 8 so that we get $$\Delta V_{out} = (I_1 - I)R1 + (I_1 - I)R2 + \frac{kT}{q}\ln(I_1) - \frac{kT}{q}\ln(I) \qquad \text{Eq. 11}$$

As $$I_1 = I + \frac{d\Delta_{BE}}{R2},$$

we can substitute in $$\Delta V_{out} = \frac{d\Delta_{BE}}{R2} \cdot R1 + \frac{d\Delta_{BE}}{R2} \cdot R2 + \frac{kT}{q} \ln\left(\frac{I + d\Delta_{BE}}{I}\right) \quad \text{Eq. 12}$$

As $I+d\Delta_{BE}$ tends to zero, then $$I_n\left(\frac{I + d\Delta_{BE}}{I}\right)$$

tends to zero.

Therefore $$\frac{\Delta V_{out}}{\Delta V_{BE}} = \text{gain} = 1 + \frac{R1}{R2} \quad \text{Eq. 13}$$

Hence, once the scaling ratio N is chosen, the designer can then set the gain based on the ratio of the resistors 30 and 32, having values R1 and R2.

Often this ratio is a non-integer value, and to facilitate good matching within the limited constraints of the layout aspect ratio of the desired physical circuit, resistors 30 and 32 with values R1 and R2 can be made up of multiple series parallel combinations of smaller unit layout resistors. For example, if resistor 30 (R1) was to have a nominal value of 22.5 Kohms and resistor 32 (R2) to have a nominal value of 2 Kohms, so as to maintain a ratio of 11.25, a unit layout resistor of 2 kohms could be chosen, and resistor 30 (R1) be made from a total of 15 single layout units arranged as 11 single units in series with 1 fractional unit made from 4 single layout units in parallel, and 32 (R2) made from 1 unit. Furthermore, to facilitate interdigitation and reduced effects of gradients and spreads on a given single layout unit, resistor 32 (R2) could be made from 16 single layout units arranged as 4 strings in parallel each made from 4 single layout units in series, in this way 15 single layout units of resistor 30 (R2) could be interdigitated with 16 single layout units of resistor 32 (R2). This breaking of resistors into smaller unit layout components does not change the electrical equivalence of the resistors 30 and 32 having values R1 and R2.

Of course, in reality it is never as easy as that. In electronic circuits noise is also an important consideration. This is especially so in voltage reference circuits as the reference voltage that they generate is supplied to other components, such as analog to digital converters, digital to analog converters, and a whole host of other circuits where noise in the voltage reference signal can degrade the performance of the other circuit.

The resistors R1 and R2 that set the gain are a source of thermal noise. The RMS thermal nose Vn from a resistor can be expressed as $$Vn = \sqrt{4kTR\Delta F} \quad \text{Eq. 14}$$

Where R is the resistance of the resistor and ΔF is the bandwidth under consideration.

In power conscious environments the resistors may have to be sized so as to keep the current flow required to achieve $\Delta V_{BE}$ low. Thus the resistors may be in the order of kilo-ohms or tens of kilo-ohms in size to meet the current flow requirements but this can come with a noise penalty. The noise from the resistors also gets gained up by the amplifier 22. This means larger $\Delta V_{BE}$ is desirable as it reduces the gain required of the amplifier.

One way to increase the $\Delta V_{BE}$ is to increase the scaling ratio N. However as the scaling ratio is acted on by the natural logarithm function In(N) then modest gains in $\Delta V_{BE}$ come with large changes in the scaling ratio. This rapidly increases the size of the circuit on the semiconductor die, and hence its fabrication cost.

In the above table a $\Delta V_{BE}$ of 53.7 mV is obtained with a scaling ratio of 8. Thus the PTAT pair of transistors occupy an area of 9 time that of transistor Q2. To double that $\Delta V_{BE}$ to 107.5 mV the scaling ratio has to be increased to 64. Thus the PTAT pair of transistors occupy an area of 65 times that of transistor Q2. This approach rapidly becomes relative costly in terms of die area.

Another way to increase the $\Delta V_{BE}$ is the use of stacked PTAT voltage generators, as also described in U.S. Pat. No. 8,508,211.

Figure 2:
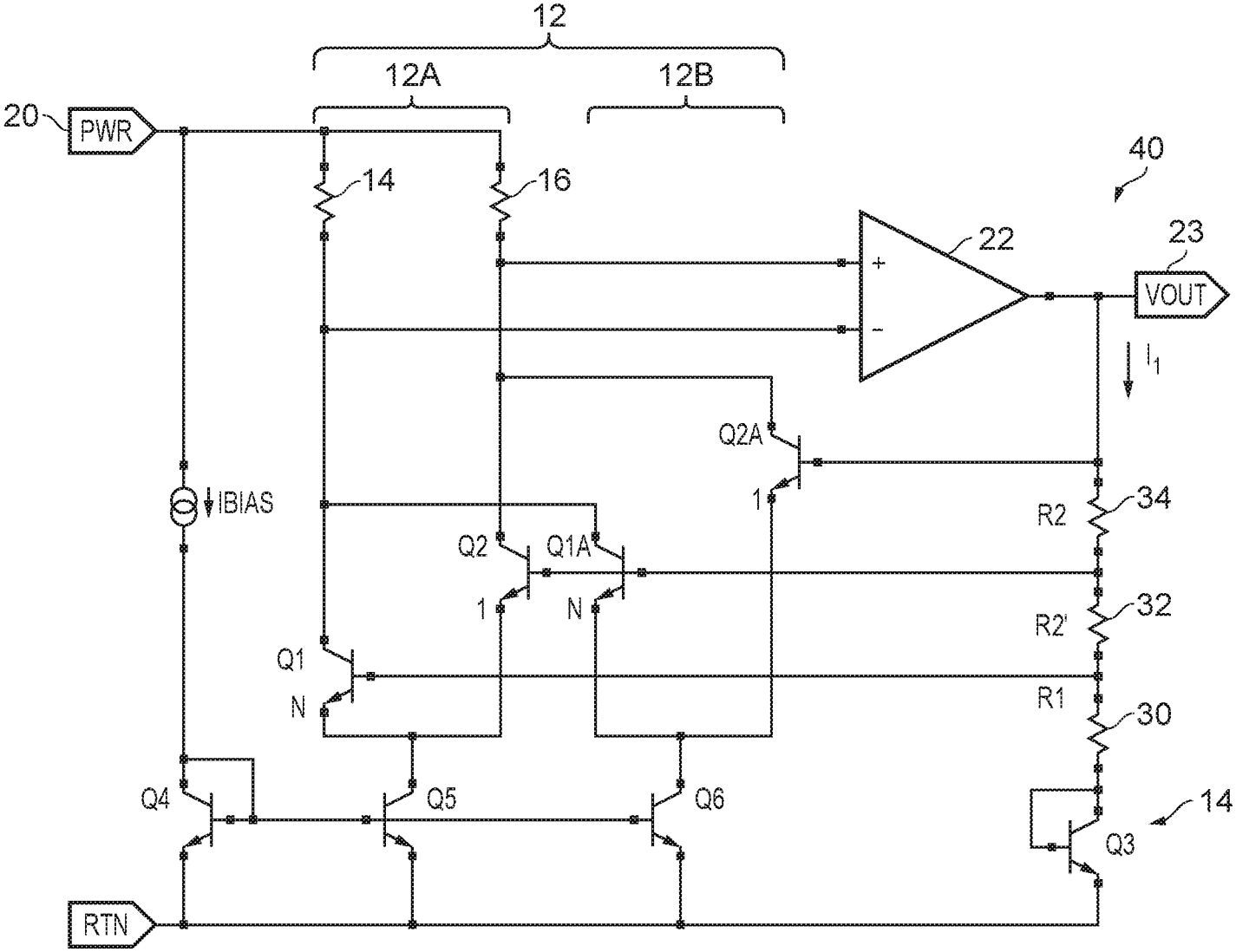
FIG. 2 is a circuit diagram of a multi-PTAT cell band gap voltage reference.

Referring to FIG. 2, further PTAT cells, such as a second PTAT cell 12B formed by transistors Q1A and Q2A are arranged such that their $\Delta V_{BE}$ voltage differences are added to that of the first PTAT cell 12A formed from transistors Q1 and Q2 by way of the action of a chain of resistors formed by Resistors 30, 32, 34. In the two cell example the gain of the amplifier is reduced by a factor of 2, and the effective noise contribution is reduced by $2\sqrt{2}$ as we now have 2 resistors 32 and 34 acting as independent noise sources with less gain. However a disadvantage of this circuit is that the voltage at the inputs of the amplifier inevitably is moved closer to that of the amplifier supply rail and hence the headroom of operational circuits within the amplifier becomes squeezed. It should be understood that further PTAT cells can be added, but this exacerbates the voltage headroom problem at the amplifier.

A further problem introduced by having larger resistors (so as to meet power budgets) is that the effect of the base currents drawn by the transistors become more problematic.

The relative size of the base current drawn from the resistor chain formed by resistors 30, 32, 34 (and further resistors if more than two PTAT cells are provided) when the cells are stacked causes the output voltage to change from its ideal value—e.g. the value that would be achieved if the transistors did not draw a base current.

Consider the circuit of FIG. 2 more closely.

For simplicity we shall assume that all of the transistors Q1, Q2, Q1A and Q2A exhibit the same current gain β, and that each of the transistors Q5 and Q6 generate a tail current $2I_T$.

From this, each of the transistors Q1, Q1A, Q2 and Q2A each pass a current $I_T$ and the base current $$\frac{I_T}{\beta}.$$

We can see that if resistor 34 passes a current $I_1$, then the current in resistor 32 is $$I_1 - \frac{I_T}{\beta}$$

the current in resistor 30 is $$I_1 - \frac{3I_T}{\beta}$$

As will be shown later, the voltage drop across the resistor 30 of value R1 is notable here, and $V_{out}$ is decreased by $$3 \times R1 \cdot \frac{I_T}{\beta} \quad \text{Eq. 15}$$

At first sight, this gives a small constant drop in output voltage, which could be addressed by quoting the output voltage to be slightly lower by $$3 \times R1 \cdot \frac{I_T}{\beta}.$$

Figure 3:
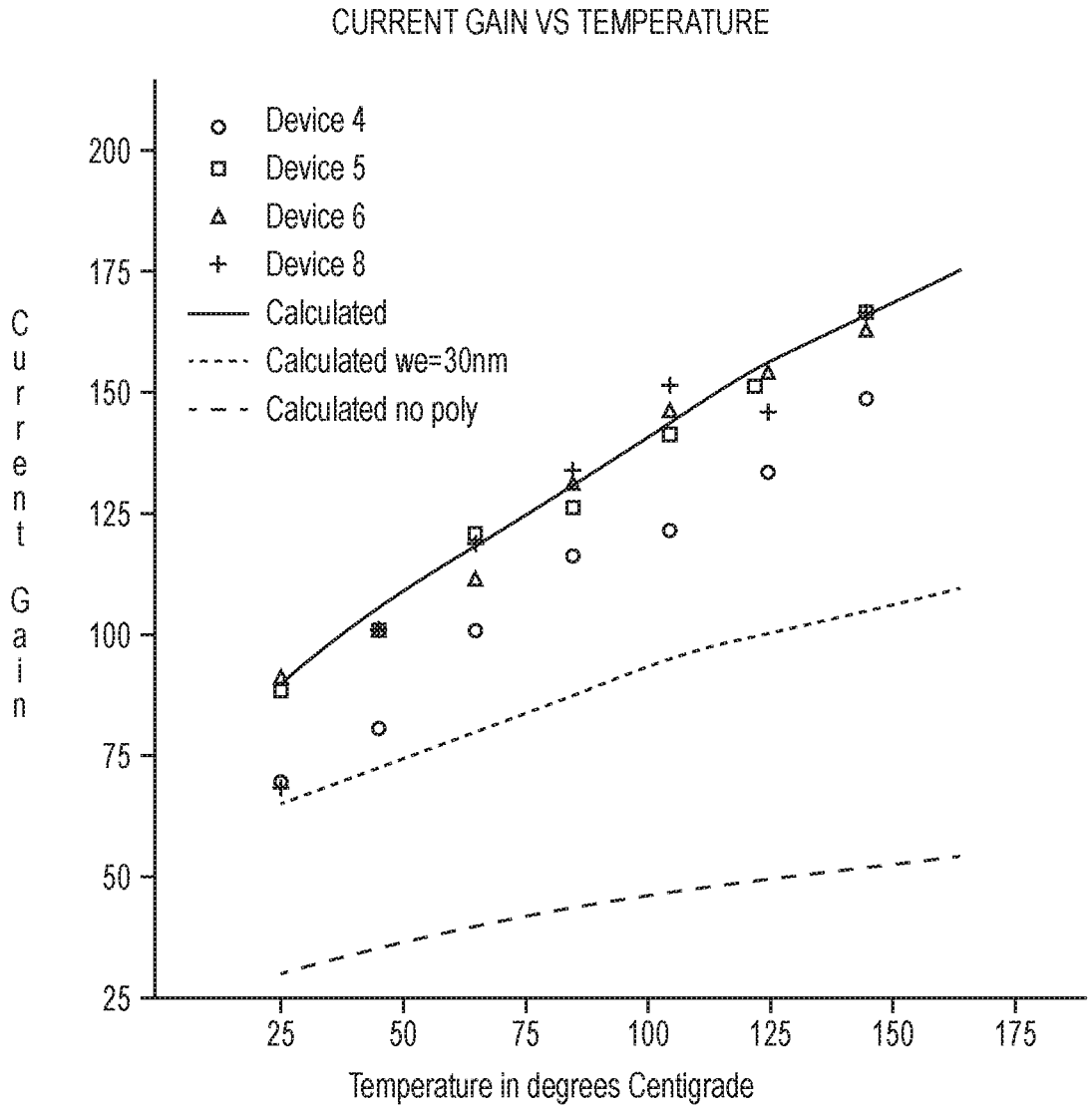
FIG. 3 is a graph of a current gain (β) versus temperature for a bipolar transistor.

However, whilst $I_T$ can be set to be substantially constant, β changes with device temperature, mechanical stress and from wafer to wafer. The change in β can be quite significant. A graph of β versus temperature is shown in FIG. 3. Here β could change by a factor of 2 over a 100° C. temperature range. The data in FIG. 3 is reproduced from a PhD thesis, "Optimization and temperature dependence of current gain in Polysilicon-Emitter contacted transistors", Williams, C. Lea, Oregon Graduate Center 1988, available at:
https://digitalcommons.ohsu.edu/cgi/viewcontent.cgi?article=1265&context=etd Thus the variation in the output voltage due to base current flow is temperature dependent.

By way of example, suppose that the circuit of FIG. 2 was operating the PTAT cells with tail currents of 20 μA such that each transistor nominally passed a collector current of 10 μA. If the transistors have a β of 100, then the base currents are 100 nA.

Therefore, if R1 was 50 K, the voltage change due to the base currents would be 15 mV.

If, as a result of a temperature change, such as that shown in FIG. 3, the β doubled over approximately 100° C., then the voltage change due to the base currents would be about 7.5 mV.

This change of 7.5 mV over 100° C. for a reference having, say, a nominal output voltage of say 1.25 V gives a temperature coefficient of around 60 ppm per ° C. The gain applied, which is set by the ratio of R1 to R2, can be altered to compensate for this error, but it will be appreciated that this 'fix' only works for one nominal β and β vs temperature characteristic, and this may change batch to batch, complicating the ability to trim or use one static setting for the gain ratio needed to achieve an optimum but less controlled temperature coefficient. It is also further compounded when β might be lower such as when using vertical bipolar devices made from available implants in CMOS processes, where the values of β maybe anywhere from 2 to 25.

More notable is that β may not remain constant during the lifetime of the product, for example due to package stress. The package stress may be variable and there would be no means to compensate the settings of R1 and R2 for the subsequent change, so if for example β was 10 instead of 100 each base current would be 1 uA instead of 100 nA and if the beta then changed by 1% the base current would change by 10 nA which would induce a change of 1.5 mV to the bandgap output, which is approximately 1.25% of the output.

Whilst that is acceptable for some applications, it would be desirable to do better.

Figure 4:
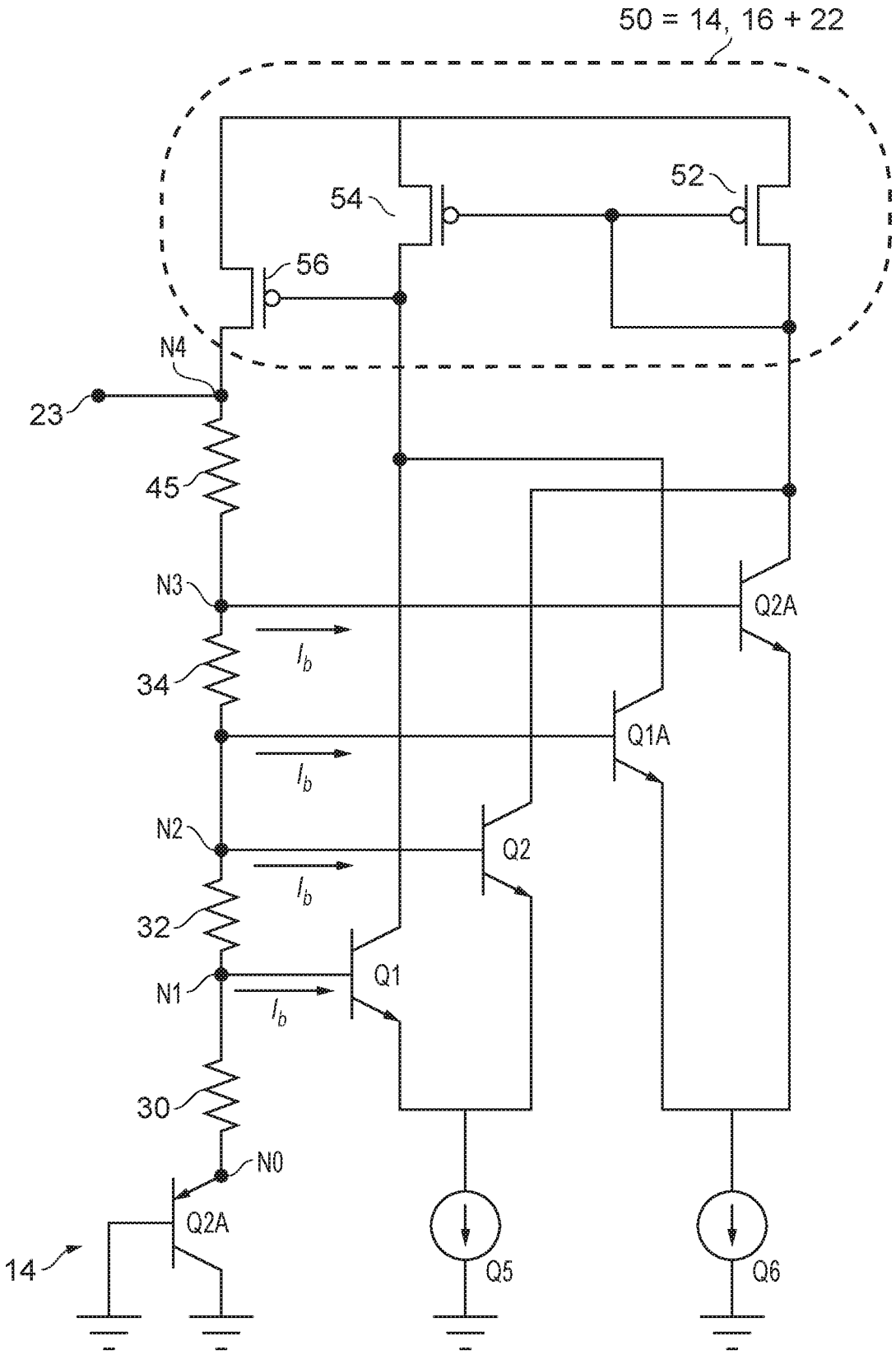
FIG. 4 is a circuit diagram of a multi PTAT cell voltage reference constituting an embodiment of this disclosure.

However, the inventors realized that this base current problem could be mitigated by adding a further resistor as shown in FIG. 4.

FIG. 4 is generally equivalent to the circuit shown in FIG. 2, except for the inclusion of a further resistor 45 between the output 23 of the operational amplifier 50 and the first node of resistor 34, to which the base of Q2A is connected.

Resistor 45 can be regarded as a "correction component" for compensating for the change in output voltage as a result of the flow of base currents into the transistors Q1, Q1A, Q2 and Q2A.

Additionally, in FIG. 4 the load resistors 14 and 16 have been replaced by an active load formed by transistors (in this case P-type FETs but bipolar transistors could also be used) 52 and 54. The active loads are well known to the person skilled in the art of operational amplifier design, and allow the transistors Q1, Q1A, Q2 and Q2A to act as input stages of an operational amplifier as well as generating the PTAT voltages. Transistor 56 acts as an output stage for the operational amplifier formed using transistors 52, 54, 56 and the PTAT transistors Q1, Q2, Q1A and Q2A. It will be understood that noise reduction and matching techniques can be applied to the amplifier and that, for example, these PMOS devices could be chopped to reduce their error and low frequency noise contributions.

Furthermore, for the sake of completeness it is noted that the CTAT cell 14 can be formed using a diode connected PNP transistor, as is shown in FIG. 4. A nominal advantage of the PNP device is that it is less dependent on stress.

In order to see how resistor 45 corrects for base current flow, it is easier to start with a simpler circuit, such as a voltage reference circuit of FIG. 1 having a single PTAT cell.

Figure 5:
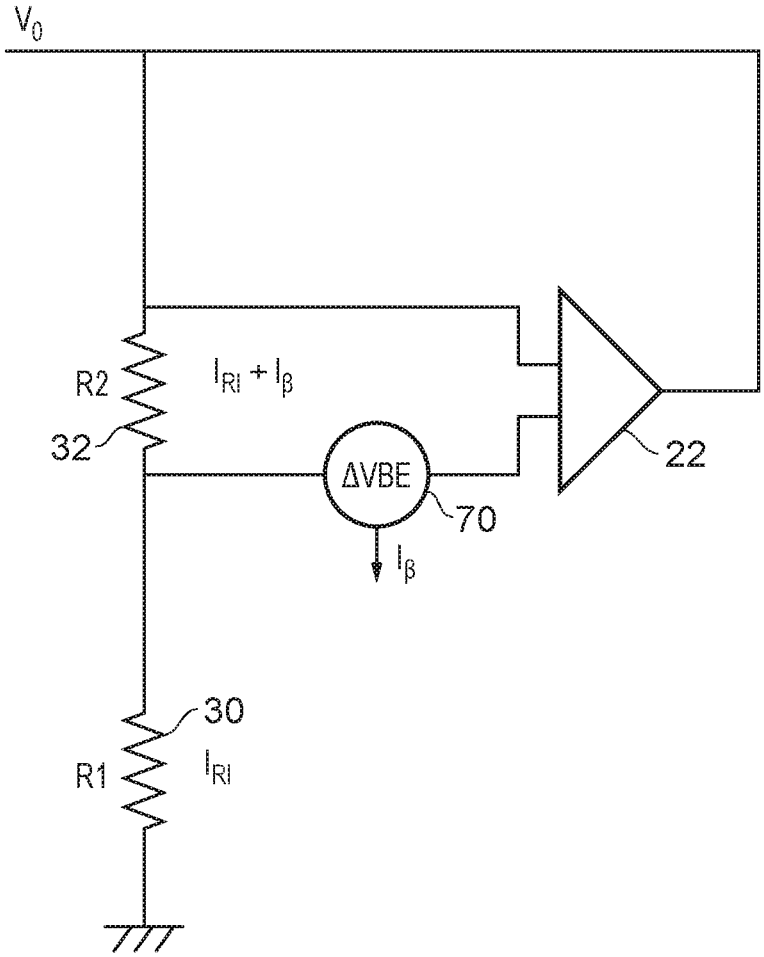
FIG. 5 is an equivalent circuit of a single PTAT cell and control circuit so as to illustrate the consequence of base current flow.

If we redraw FIG. 1 as an equivalent circuit shown in FIG. 5, to highlight the fact that the function of the operational amplifier 22 is to keep the voltage across R2 equal to and opposed to $\Delta V_{BE}$ (so as to keep the voltages at the inverting and non-inverting inputs of the operational amplifier equal to each other) then it becomes easier to see the effect of the base current drawn by Q1, represented as $I_\beta$ leaving the $\Delta V_{BE}$ voltage generator 70.

As $\Delta V_{BE}$ is, at a given temperature, fixed then $I_{R1}+I_\beta$ is also fixed. Thus, if for example $I_\beta$ increases as a result of stress or process variation, $I_{R1}$ must decrease by the same amount.

Therefore the voltage across the first resistor 30 drops by $I_\beta$R1 due to base current flow. As $V_{out}$ is the sum of the voltage across R1 and R2, and the action of the feedback circuit is to hold the voltage across R2 to be constant, then we see that $$dV_{out}(I_\beta) = -I_\beta R1 \quad \text{Eq. 16}$$

If we look at FIG. 1, if Q5 passes a tail current $I_{tail}$, then $$dV_{out}(I_\beta) = \frac{-I_{tail}}{2} \cdot \frac{1}{\beta+1} \cdot R1 \quad \text{Eq. 17}$$

where β is the current gain of the transistor.

However, the inventors realized that the voltage drop across R1 due to the base current $I_\beta$ could be compensated by providing a compensation component, namely a further resistor 45 between the second resistor 32 and the output node.

Figure 6:
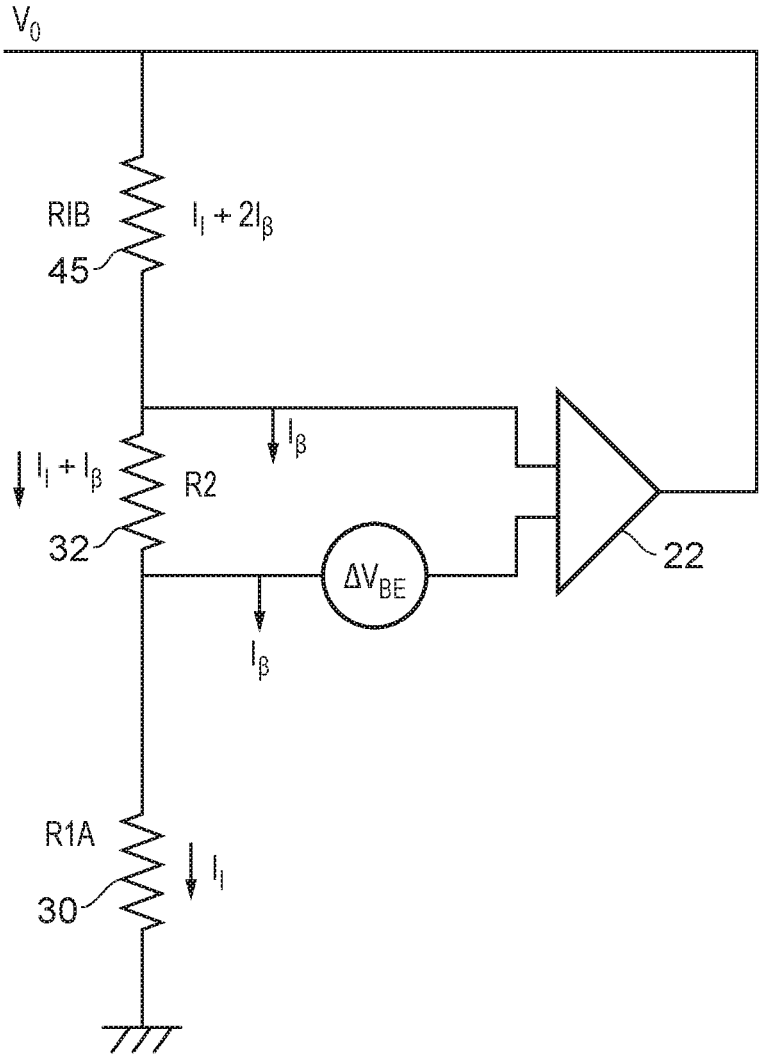
FIG. 6 shows the equivalent circuit of FIG. 5, with additional base current flows included in the analysis of the circuit.

Of course the current flow into the base of Q2 now becomes important. If we look at FIG. 6, where a compensation resistor 45 having resistance resistor R1B has been added and where the first gain setting resistor 30 has a value R1A we can see that in the absence of any base current $$V_0=I_0(R1A+R1B+R2) \quad \text{Eq. 18}$$

and $\Delta V_{BE}=I_0R2$
hence $$V_0=\frac{\Delta V_{BE}}{R2}(R1A+R1B+R2) \quad \text{Eq. 19}$$

If we now allow each transistor to draw $I_\beta$, then we can replace the current $I_0$ which previously flowed in each of the resistors by differing amounts, namely $I_1+2I_{\beta\ in\ R1B}$ $I_1+I_\beta$ in R2 and $I_1$ in R1A Also, due to the nature of the feedback loops and the operational amplifier working in R2, we know $$I_0=I_1+I_\beta \quad \text{Eq. 20}$$

Hence, if we introduce $I_\beta$ and calculate a modified output voltage $V'_0$ $$V'_0=R1A\cdot I_1+R2(I_1+I_\beta)+R1B(I_1+2I_\beta)=R1A(I_0-I_\beta)+R2(I_0-I_\beta+I_\beta)+R1B(I_0+I_\beta+2I_\beta) \quad \text{Eq. 21}$$

so $$V'_0-V_0=R1A(I_0-I_\beta-I_0)+R2(I_0-I_0)+R1B(I_0+I_{62}-I_0) \quad \text{Eq. 22}$$

$$\Delta V=R1B\cdot I_\beta-R1A\cdot I_{62} \quad \text{Eq. 23}$$

Hence ΔV=zero if R1A=R1B, and is independent on the base current $I_\beta$ and hence independent of β.

Thus there is no change in $V_0$ as a result of the transistors drawing a base current if R1A=R1B. This means that the output voltage from one voltage reference to the next will be stable, over temperature and process variations.

Although harder to show the same result holds true for cascaded stages like those shown in FIG. 4.

Thus, the temperature coefficient can be improved by the addition of the compensation resistor 45. In reality the resistors do not need to be exactly matched, but if matched to within 20% then the temperature coefficient resulting from the base current flow will be improved by a factor of 5 as would any subsequent change due to package stress or ageing. Similarly if the resistors are matched to 1%, then the voltage change due to stress or the control of temperature coefficient charge resulting from the base control is improved by a factor of 100.

The first gain setting resistor 30 and the compensation resistor 45 may be matched to better than 40%, to better than 30%, to better than 20%, to better than 10%, to better than 5%, to better than 2%, to better than 1%, or even better than that.

Adding the compensation resistor 45 also changes the gain, so this can be taken into account. Thus the compensation resistor can also be regarded as a second gain setting resistor. If resistor 45 is the same value as resistor 30, then for the desired gain each has a value of $$\frac{R1}{2}$$

where R1 represents the value of gain setting resistor 30 in a circuit without the compensation resistor.

Thus, if $R1_0$ is the value of R1 required to provide the correct gain when no compensation resistor R1B is provided, we can say $$R1A+R1B=R1_0 \quad \text{Eq. 24}$$

and advantageously R1B should be within 20% of the value of R1A. It will be appreciated that to trim the bandgap for optimum temperature coefficient from batch to batch, it is possible to trim both resistors 30 and 45 having values R1A and R1B equally to maintain the relationship that ensures correction, or as a simpler but less effective approach it is possible to trim or tap-off from just resistor 30, in which case the amount of correction will change as a function of the trim, however it will still result in less sensitivity to any subsequent change in the current gain β.

Because of the need to trim it may be that R1A vs R1B may need to change by up to a further 20% each, i.e. up to 40% in total, which still improves the dependence on β by a factor of 2.5

Another reason R1A and R1B may not be the same value is if there is an additional resistance outside the nominal circuit to account for, for example any parasitic resistance in Q3 or any additional resistor of a different material that has been added to aid with curvature correction.

As resistors 30 and 45 having values R1A and R1B differ there is less cancellation for base current as a result of changes in β, but this may be combined with other techniques to reduce the effect of β changes in Q1 and Q2, such as putting a resistor R3 in the path of the base of Q2 in order to provide a drop that is dependent on β in the formation of $dV_{BE}$. A downside of this approach is that this resistor increases the noise of the overall solution.

Returning to FIG. 4, the resistor string is formed between nodes N0 and N4, with the compensation resistor 45 being in the current flow path to the bases of the transistors, which in this example is between nodes N4 and N3. The gain setting is performed in part by a gain setting resistor 30 between nodes N1 and N0, where all of the base currents have been removed and part by gain setting resistor 45 between nodes N3 and N4 where all the base currents are present It should be appreciated that if R1A is 20% different to R1B Ib then effects the output by $1/5^{th}$, however this can be approximately compensated for by nominally making R2B different to R2A so that the average effect of Ib on both R2B and R2A matches the average effect of Ib on R1B and R1A.

Both of these approaches can be extended to multiple $dV_{BE}$ configurations beyond two.

The voltage reference circuit can of course be implemented using PNP transistors in the PTAT cell to give a version that works with a negative supply rail or where the output voltage is referenced with respect to the positive power rail. A PNP PTAT cell can be made with respect to GND with appropriate amplifier configuration to fold its output current to alter the current flow in R1 and R2.

The voltage reference circuit can also be formed of complementary PTAT cells, i.e. some cells are implemented using PNP transistors and other cells are implemented using NPN transistors.

Figure 7:
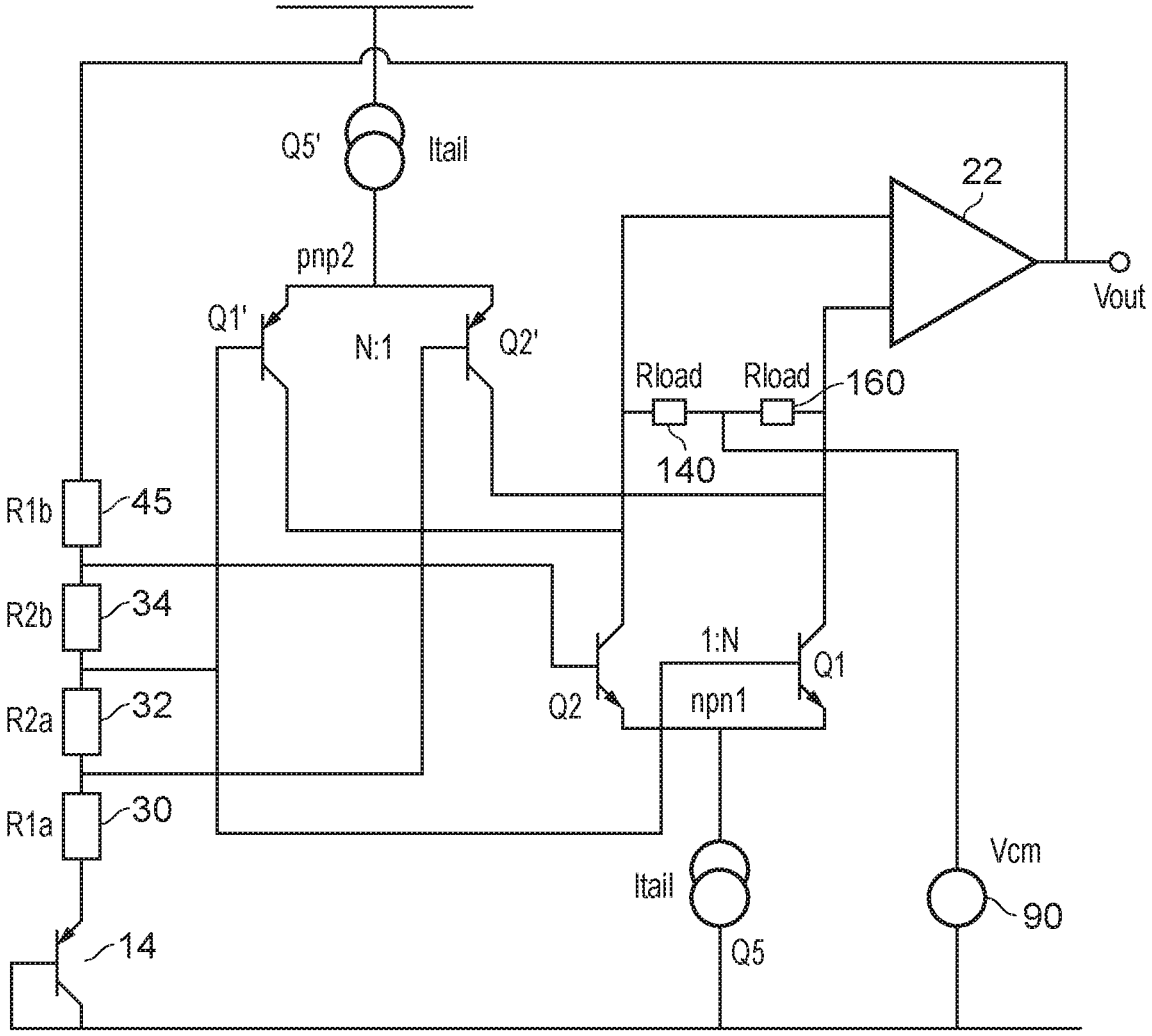
FIG. 7 is a circuit diagram of an embodiment of this disclosure having complementary PTAT cells.

FIG. 7 shows an arrangement in which the first PTAT cell is in current flow communication with a first complementary PTAT cell. Here the first PTAT cell comprises NPN transistors Q1 and Q2 where Q1 is N times the size of Q2. As with the case with the earlier embodiments the emitters of Q1 and Q2 are connected together and to a tail current generator Q5 which connects them to the negative supply rail or to ground. The complementary first PTAT cell comprises PNP transistors Q1' and Q2' with Q1' having an area N times that of Q2'. The emitters of Q1' and Q2' are connected together and to a tail current generator Q5' which is connected to the positive supply rail. The collector of Q1' is connected to the collector of Q2. The collector of Q2' is connected to the collector of Q1. A first resistor 140 is connected in series with a second resistor 160 between the collectors of Q1 and Q2 and a node intermediate resistors 140 and 160 is connected to a common mode voltage generator 90 so as to hold it at a desired voltage. The voltage at the collectors of Q1 and Q2 are provided to the inputs of a differential amplifier 22. The output of the amplifier is, as before, provided to resistor string comprising four resistors 30, 32, 34 and 45 where resistor 45 is the base current compensation resistor.

The bases of Q1 and Q1' are connected together and to a node between the second resistor 32 and the third resistor 34. The base of Q2' is connected to a node between the resistor 30 and the resistor 32, whereas the base of Q2 is connected to the node between the third resistor 34 and the compensation resistor 45. A CTAT current cell 14, in this instance comprising a diode connected PNP transistor, is positioned between the first resistor 30 and the ground rail. In this way we also achieve the benefit of stack combination in terms of reducing the noise contributions of R1 (32,34) by using the $dV_{BE}$ of one type transistor (PNP for Q1' and Q2') with one resistor 32 and the dVbe contribution of the other type transistor (NPN for Q1 and Q2) with the other resistor 34

For the arrangement shown in FIG. 7 the analysis shows that the output voltage is given by $$V_{out} = V_{BE}(PNP) + \left(\frac{(R1A + R1B) \times (dV_{BE}(NPN1) + dV_{BE}(PNP2))}{(R2A + R2B)}\right) \quad \text{Eq. 25}$$

The use of complimentary cells allows the tail current to be reused and improves the power to noise ratio of the amplifier loop. This can represent a significant saving as the same collector current noise density contribution of the combined complementary $dV_{BE}$ stage can be achieved with approximately half the current. Furthermore, the use of complementary cells also allows the headroom requirements of the circuit to be improved.

Additional PNP cells can easily be added towards the VSS connection, and additional NPN $dV_{BE}$ cells can be added in the direction of the output, so with this complementary $dV_{BE}$ bandgap it is possible to stack many $dV_{BE}$ cells. However, the beta effect due to the PNP and due to the NPN are not compensated for.

Figure 8:
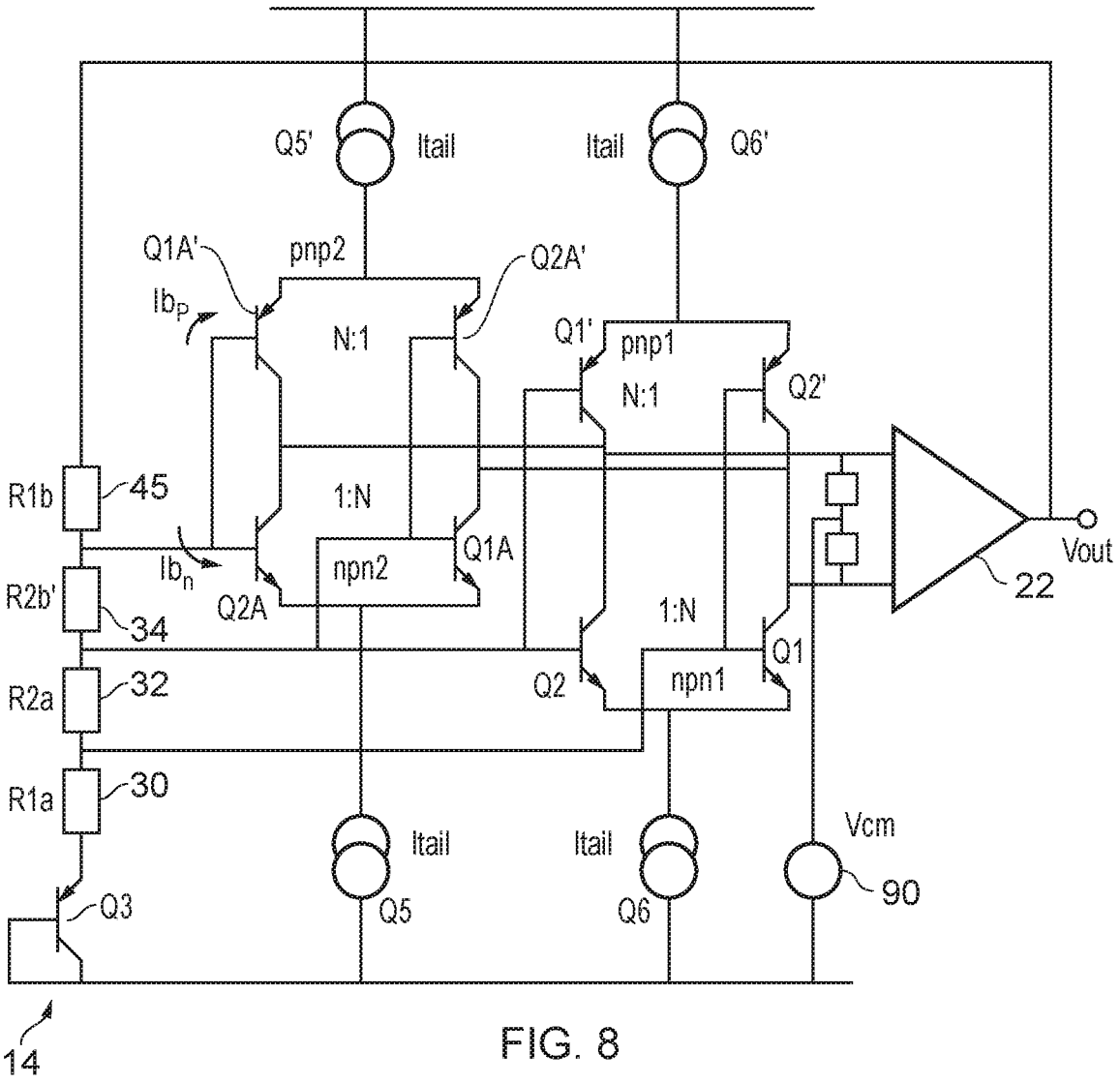
FIG. 8 is a circuit diagram of an embodiment of this disclosure having a plurality of pairs of complementary PTAT cells.

The use of common base complementary cells such as that shown in FIG. 8 can address that. The second complementary cell has the same configuration with respect to the second PTAT cell as the first complementary cell has with respect to the first PTAT described with respect to FIG. 7. As stack cells are used each stack of PTAT and complementary PTAT cells has their own tail current generators. Thus in this example the second cell has a tail current generator Q6 and Q6' extending between the ground and positive supply rails respectively. The output voltage for the arrangement shown in FIG. 9 can be described by $$V_{out} = V_{BE}(PNP) + \left(\frac{R2A + R2B}{R1A + R1B}\right) \times \left(\left(\frac{dV_{BE}(NPN1) + dV_{BE}(PNP1)}{2}\right) + \left(\frac{dV_{BE}(NPN2) + dV_{BE}(PNP2)}{2}\right)\right) \quad \text{Eq. 26}$$

Figure 9:
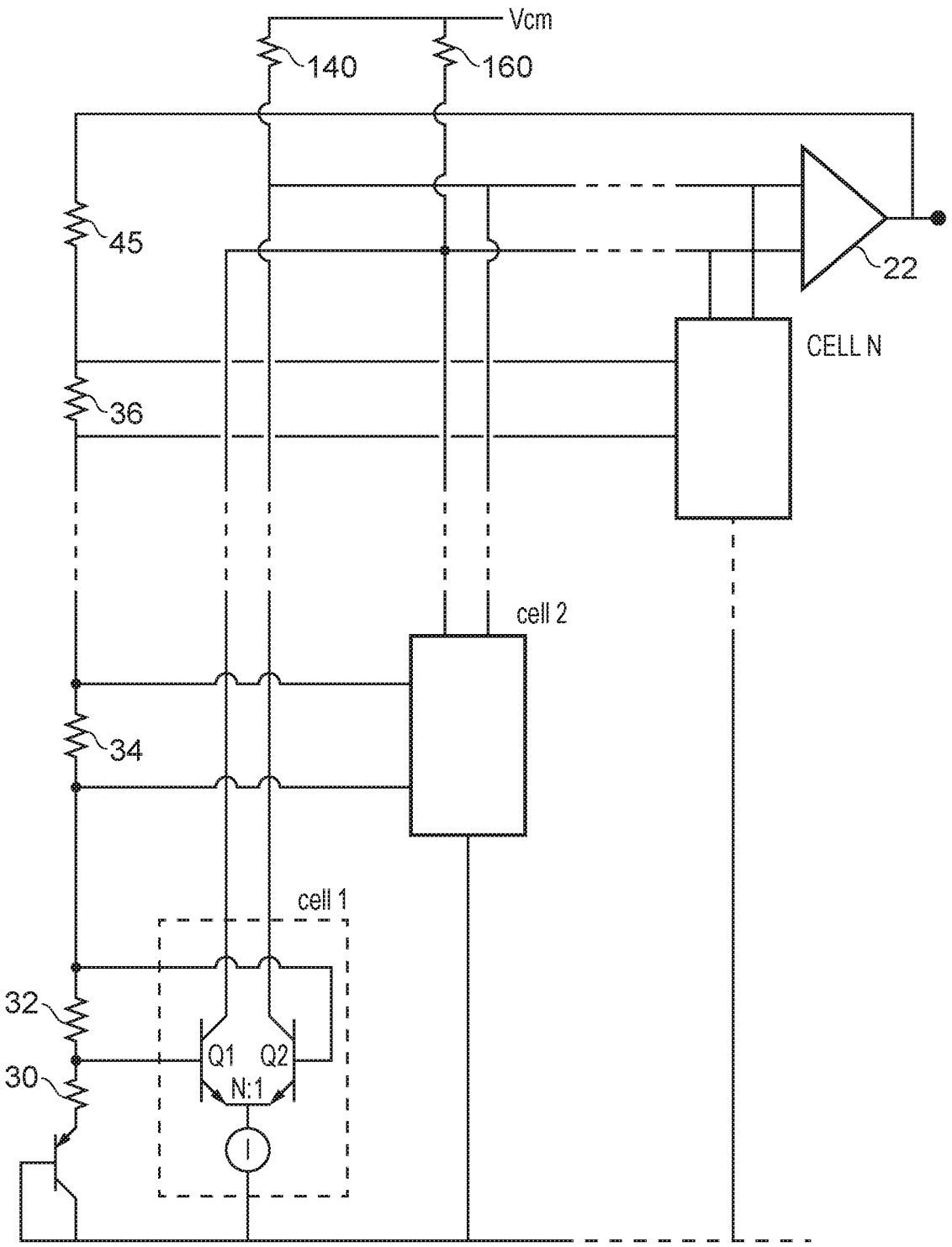
FIG. 9 is a circuit diagram of a voltage reference circuit comprising N PTAT cells and operating in accordance with the teachings of this disclosure.

In the circuits of FIGS. 4, 8 and 9 the CTAT generator has been at the supply rail end of the resistor string formed by resistors 30, 32 and so on. This is convenient because the voltage headroom taken up by having the CTAT cell 14 at this position makes it easier to implement the tail current generator Q5 without incurring an additional headroom cost. However, since the output voltage is the sum of the individual voltages across any of the components, it follows that the CTAT cell can in fact be put at any position in that current flow path between Vout and the ground rail.

For completeness, FIG. 9 repeats the circuit diagram of FIG. 4, but with multiple cells cooperating to form the PTAT voltage. Each cell is identical in configuration and only "cell 1" is shown in detail. Cell 1 comprises first and second transistors Q1 and Q2 with Q1 being N times the size of Q2. The emitters are connected to a tail current generator passing a current I. Further cells, Cell 2 . . . Cell N are provided. As shown the bases of the transistors in each cell are held at respective voltages by virtue of being connected to opposing ends of resistors 32, 34, 36 and so on, which themselves are connected in series between the first gain setting resistor 30 and the compensation resistor 45. The currents flowing through the Q1s of the cells are summed, as are the currents flowing through the Q2s and these are compared and used set an output voltage as described hereinbefore.

It should be noted that embodiments using complementary cells, as shown in FIGS. 7 and 8, can be formed with the compensation resistor 45 omitted and replaced by a wire/short circuit.

Up to now, we have generally been looking at balanced conditions, where $$R1a = R1b = R1_0/2 \text{ and } R2a = R2b = R2_0/2 \quad \text{Eq. 27}$$

Also the base current for Q1, $Ib_{n1}$, is the same as the base current for Q2, $Ib_{11}$, in the first cell formed by Q1A. and Q2. For the second cell formed by Q1A and Q1B we can say the base current for Q1A, $Ib_{n2}$, is the same as the base current for Q2A, $Ib_{12}$.

$$\text{In fact } Ib_{11} = Ib_{1n} = Ib_{12} = Ib_{n2} = Ib \quad \text{Eq. 28}$$

We can see that the base current contribution to the output can be expressed for the gain and compensation resistors as $$(R1_a{*}4Ib) + (R1_b{*}0I_b) = R1_0{*}2I_b \quad \text{Eq. 29}$$

and for the control voltage generating resistors $$(R2_a{*}3Ib) + (R2_b{*}I_b) = R2_0{*}2I_b \quad \text{Eq. 30}$$

These base currents are the same, so they can be compensated.

Now suppose that as a result of trimming or for other reasons $R1_a$ and $R1_b$ are not equal. For a worked example we pick $$R1_a = 1.25\ R1_0/2$$

$$R1_b = 0.75\ R1_0/2$$

such that $R1_a + R1_b = R1_0$

All other resistors stay the same.

Then for the gain and compensation resistors, the effect of the base current is $$((1.25*R1_0/2*4I_b)+(0.75*R1_0/2)*0I_b)=\frac{5I_b}{2}R1_0 \quad \text{Eq. 31}$$

The base currents no longer have the same influence. As such a change in $I_b$ can only be partially compensated.

However partial correction can be achieved by unbalancing $R2_a$ and $R2_b$.

So if, for example $R1_a$=1.25 $R1_0/2$ and $R1_b$=0.75 $R1_0/2$ as before, but now we mismatch $R2_a$ and $R2_b$, for convenience by the same amount $R2_a$=1.25 $R2_0/2$ and $R2_b$=0.75 $R2_0/2$ then $Ib_{11}>Ib_n$, $Ib_{12}<Ib_{n2}$ If we substitute the average current of each pair as $I_b$, and the difference in base current of each pair as $dI_b$ then, for the gain and compensation resistors, the voltage due to base currents is $$(1.25*R1_0/2*4I_b)+(0.75*R1_0/2*0I_b)=5R1_0/2*I_b \quad \text{Eq. 32}$$

and for the control voltage resistors $$(1.25*R2_0/2*((3I_b+dI_b))+(0.75*R2_0/2*(I_b-dI_b))=R2_0/2(3.75I_b+0.75I_b+1.25\ dI_b-0.75I_b)$$

so, tidying the voltage change is $$R2_0/2(4.5I_b+0.5dI_b) \quad \text{Eq. 33}$$

which is closer.

Solutions can be found to a desired accuracy by analytical or numerical methods.

Further compensation can be achieved by introducing a series resistor in the path to the bases of one or more transistors.

Figure 10:
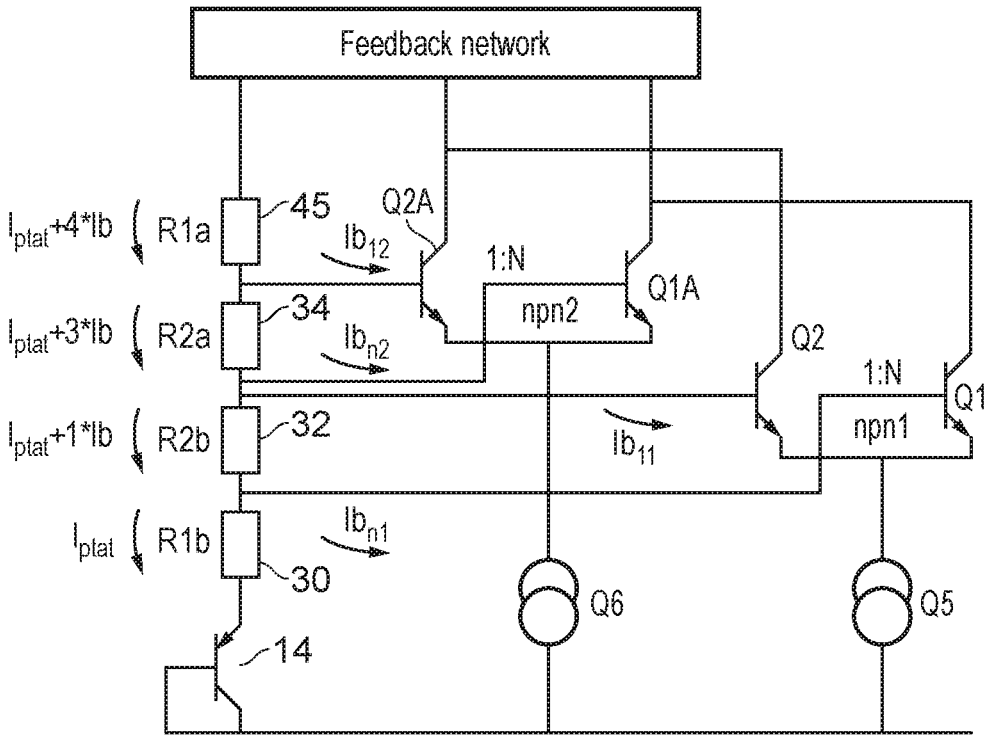
FIG. 10 is a circuit diagram showing how mismatch between gain and compensation resistors, where such mismatch may be deliberate, can be compensated at least in part by mismatching the control voltage generating resistors.
Figure 11:
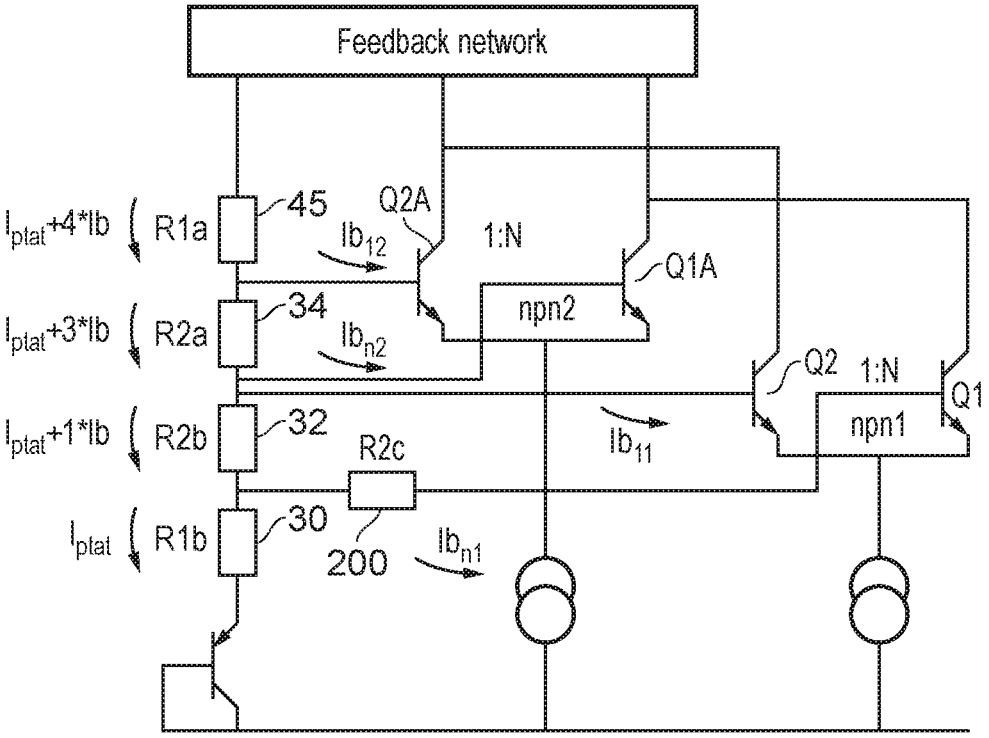
FIG. 11 is a circuit diagram showing a further embodiment of this disclosure having a series base resistor.

FIG. 11 repeats the circuits of FIG. 10 but an additional resistor 200 of value R2c has been added in the path to Q1.

Letting $R1_a$=1.25 $R1_0/2$ $R1_b$=0.75 $R1_0/2$ $R2_a$=$R2_b$=$R2_0/2$ $R2_c$=$R2_0/2$ Now the voltage charges can be equated for the groups of resistors as before.

For the gain and compensation resistors, the voltage change due to $I_b$ is $$(1.25*R1_0/2*4I_b)+(0.75*R1_0/2*0I_b)=(R1_0/2)5I_b \quad \text{Eq. 34}$$

For the other resistors, the voltage changes is $$(R2_0/2*3I_b)+(R2_0/2*I_b)+(R_{comp}*I_b)=(R2_0/2)5I_b \quad \text{Eq. 35}$$

Thus the changes due to base current flow are both proportional to $5I_b$ and hence can be compensated for.

It is thus possible to provide an elegant arrangement for compensating for output voltage variation due to base current flow in a PTAT cell.

It possible to combine multiple stacks of CTAT and PTAT generators can be combined such as to create voltage other than those of single bandgaps The claims presented herein are in single dependency format suitable for filing at the USPTO but it is to be understood that this is merely an artefact of the claims fee structure of the USPTO and that any claim can be singly or multiply dependent on any preceding claim of the same type (e.g. apparatus or method) unless that is clearly technically infeasible.

The invention claimed is:

1. A voltage reference circuit comprising:

a first proportional to absolute temperature (PTAT) cell, the first PTAT cell comprising first and second transistors operating at first and second current densities, respectively, such that the transistors have first and second base-emitter voltages that differ from each other;

a control circuit for providing a reference output voltage at an output node and controlling a base voltage difference between the first and second transistors of the first PTAT cell so as to set respective collector currents flowing in the first and second transistors to a desired ratio; and correction circuitry for compensating the output voltage of the voltage reference circuit against changes in the output voltage due to a characteristic gain change in at least one of the first and second transistors.

2. The voltage reference circuit as claimed in claim 1, wherein the control circuit comprises at least one current to control voltage converter defining a plurality of nodes;

wherein the bases of the first and second transistors are connected to different ones of the plurality of nodes; and wherein the correction circuitry comprises a current to correction voltage converter arranged between a voltage output node of the voltage reference circuit and a first node of the at least one current to control voltage converter.

3. The voltage reference circuit as claimed in claim 2, wherein each current to control voltage converter comprises a resistor, and the current to correction voltage converter comprises a compensation resistor.

4. The voltage reference circuit as claimed in claim 3, in which the at least one current to control voltage converter is arranged in series with and between the current to correction voltage converter and a first gain setting resistor.

5. The voltage reference circuit as claimed in claim 4, wherein a resistance of the compensation resistor is within 40% of a resistance of the first gain setting resistor.

6. The voltage reference circuit as claimed in claim 4, wherein a resistance of the compensation resistor is within 20% of a resistance of the first gain setting resistor.

7. The voltage reference circuit as claimed in claim 4, wherein values of the first gain setting resistor and the compensation resistor are different by a ratio, and values of the resistors of the first and second current to control voltage converters are made different by the same ratio or to within ±50% of that ratio.

8. The voltage reference circuit as claimed in claim 1, further comprising a complementary first PTAT cell where a collector of a first transistor of the complementary first PTAT cell is in current flow connection with a collector of the second transistor of the first PTAT cell and a collector of a second transistor of the complementary first PTAT cell is in current flow connection with a collector of the first transistor of the first PTAT cell, and wherein the first and second transistors of the first PTAT cell are NPN transistors and the first and second transistors of the second PTAT cell are PNP transistors or vice versa.

9. The voltage reference circuit as claimed in claim 1, further comprising a second PTAT cell where a collector of a first transistor of the second PTAT cell is in current flow connection with a collector of the first transistor of the first PTAT cell and a collector of a second transistor of the second PTAT cell is in current flow connection with a collector of the second transistor of the first PTAT cell, and the first and second transistors of the first and second PTAT cells are either all NPN transistors or all PNP transistors.

10. The voltage reference circuit as claimed in claim 9, further comprising a complementary second PTAT cell where a collector of a first transistor of the complementary second PTAT cell is in current flow connection with a collector of the second transistor of the second PTAT cell and a collector of a second transistor of the complementary second PTAT cell is in current flow connection with a collector of the first transistor of the second PTAT cell, and wherein the first and second transistors of the second PTAT cell are NPN transistors and the first and second transistors of the second PTAT cell are PNP transistors or vice versa.

11. The voltage reference circuit as claimed in claim 1, further including a complementary to absolute temperature (CTAT) cell arranged such that a CTAT voltage from the CTAT cell is added to a PTAT voltage from the first PTAT cell.

12. An electronic apparatus including a voltage reference as claimed in claim 1.

13. A voltage reference circuit comprising a first proportional to absolute temperature (PTAT) cell and a second PTAT cell;

the first PTAT cell comprising first and second bipolar transistors having their emitters connected to a first shared node and arranged to operate at first and second current densities, respectively; and the second PTAT cell comprising third and fourth bipolar transistors having their emitters connected to a second shared node and arranged to operate at third and fourth current densities, respectively;

wherein:

the first and second transistors are NPN transistors;

the third and fourth transistors are PNP transistors;

a collector of the first transistor is connected to a collector of the third transistor;

a collector of the second transistor is connected to a collector of the fourth transistor; and bases of the first and second transistor are connected by a first control voltage generator and bases of the third and fourth transistors are connected by a second control voltage generator.

14. The voltage reference circuit as claimed in claim 13 further comprising a feedback loop responsive to voltages at the collectors of the first and second transistors and arranged to modify voltages produced by the first and second voltage generators.

15. The voltage reference circuit as claimed in claim 13, further comprising a first complementary to absolute temperature (CTAT) circuit in a current path between a reference output node of the voltage reference circuit and ground.

16. A method of operating a voltage reference circuit, the method comprising: biasing a first proportional to absolute temperature (PTAT) cell at a first current density configured to provide a first base-emitter voltage; biasing a second PTAT cell at a second current density configured to provide a second base- emitter voltage; controlling a first base voltage difference between first and second transistors of the first PTAT cell via a first resistor that is coupled between the bases of the first and second transistors to provide a desired ratio of collector current of the first transistor to collector current of the second transistor; providing an output voltage of the voltage reference circuit in response to the desired ratio of collector current; feeding back the output voltage to a base terminal of the first transistor of the first PTAT cell via a compensation resistor and to a base terminal of the second transistor of the first PTAT cell via the compensation resistor and the first resistor; and compensating the output voltage due to current flow into the base of the first and second transistors using a feedback voltage provided by the compensation resistor; wherein the first resistor is coupled in series between a first gain setting resistor and the compensation resistor.

17. The method as claimed in claim 16, wherein a resistance of the compensation resistor and a resistance of the first gain setting resistor are matched to within 40% of one of the resistances.

18. The method as claimed in claim 16, wherein a resistance of the compensation resistor and a resistance of the first gain setting resistor are matched to within 20% of one of the resistances.

19. The method as claimed in claim 16, in which the compensation resistor and the first gain setting resistor have the same resistance.

20. The method of claim 16, comprising controlling a second base voltage difference between the first and second transistors of the second PTAT cell via a second resistor to provide the desired ratio of collector current of the first transistors of the first and second PTAT cells to collector current of the second transistors of the first and second PTAT cells.

* * * * *